US007887375B1

(12) United States Patent
Huang

(10) Patent No.: US 7,887,375 B1
(45) Date of Patent: Feb. 15, 2011

(54) AUDIO JACK HAVING IMPROVED CONTACT

(75) Inventor: Sheng-Yuan Huang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/710,604

(22) Filed: Feb. 23, 2010

(51) Int. Cl.
*H01R 13/44* (2006.01)

(52) U.S. Cl. ..... 439/668

(58) Field of Classification Search ..... 439/668, 439/669

See application file for complete search history.

(56) References Cited

U.S. PATENT DOCUMENTS 6,595,804 B2 * 7/2003 Nagata ..... 439/668
7,351,113 B2 * 4/2008 Lee et al. ..... 439/668
7,753,738 B2 * 7/2010 Zhang ..... 439/668
7,794,285 B1 * 9/2010 Huang ..... 439/668
2006/0009082 A1 * 1/2006 Lin ..... 439/668
2007/0218773 A1 * 9/2007 Uno et al. ..... 439/668
2007/0232150 A1 * 10/2007 Lee ..... 439/668
2008/0299835 A1 * 12/2008 Lin et al. ..... 439/668
2009/0149080 A1 * 6/2009 Wu ..... 439/668

* cited by examiner

*Primary Examiner*—Gary F. Paumen
(74) *Attorney, Agent, or Firm*—WPAT, P.C.; Anthony King

(57) ABSTRACT

An audio jack adapted for receiving a mating audio plug includes an insulating housing and a contact. The insulating housing has an insertion hole for receiving the mating audio plug. A recess is formed at a front of a bottom surface of the insulating housing and communicated with the insertion hole. The contact is received in the recess and includes a base portion, a soldered portion and a resistance piece. The soldered portion bends and extends outward from a bottom edge of the base portion. The resistance piece includes an elastic arm extending forward from a front edge of the base portion, and an arc-shaped portion extending downwards from a distal end of the elastic arm and arched according to an outer periphery of the mating audio plug. A distal end of the arc-shaped portion defined as a contact portion.

6 Claims, 3 Drawing Sheets

AUDIO JACK HAVING IMPROVED CONTACT

BACKGROUND OF THE INVENTION

1. Field of the Invention

The present invention relates to an electrical jack, and more particularly to an audio jack having an improved contact.

2. The Related Art

A conventional audio jack generally includes an insulating housing and at least a contact installed in the insulating housing. The contact has a resilient arm slanting into an interior space of the insulating housing. When a mating plug pin is inserted into the interior space, the resilient arm of the contact abuts against and electrically contacts with the mating plug pin. However, the resilient arm of the contact is too short to be provided with good elastic deformation. Consequently, the contact is apt to cause plastic permanent deformation after repeated plugging, and it is hard to ensure a stable electrical contact between the contact and the mating plug pin. In order to solve above problems, a method is provided to increase a length of the resilient arm in an insertion direction of the mating plug pin to lengthen the force arm of the contact for preventing elastic permanent deformation. Nevertheless, the increased resilient arm needs a large enough receiving space to accommodate it, which increases dimensions of the audio jack.

SUMMARY OF THE INVENTION

It is an object of the present invention to provide an audio jack capable of stably connecting with a mating audio plug. The audio jack includes an insulating housing and a contact. The insulating housing has an insertion hole for receiving the mating audio plug. A recess is formed at a front of a bottom surface of the insulating housing and communicated with the insertion hole. The contact is received in the recess and includes a base portion, a soldered portion and a resistance piece. The soldered portion bends and extends outward from a bottom edge of the base portion. The resistance piece includes an elastic arm, an arc-shaped portion and a contact portion. The elastic arm extends forward from a front edge of the base portion, and the arc-shaped portion extends downwards from a distal end of the elastic arm and is arched according to an outer periphery of the mating audio plug, a distal end of the arc-shaped portion defined as the contact portion.

As described above, because the arc-shaped portion is arched according to an outer periphery of a mating audio plug, the force arm of the contact is lengthened without increasing the length of the elastic arm in a insertion direction of the mating audio plug. Therefore, the contact is provided with good elastic deformation and is effectively prevented from plastic permanent deformation even after repeated plugging, and a stable electrical contact between the contact and the mating plug pin is ensured.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE EMBODIMENT

Figure 1:
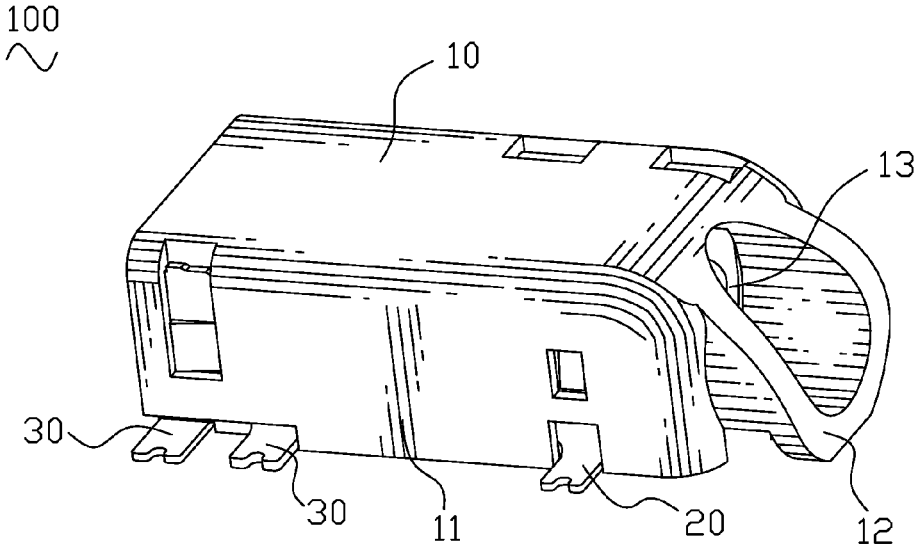
FIG. 1 is a perspective view of an audio jack of an embodiment in accordance with the present invention.

Referring to FIG. 1, an audio jack 100 according to the present invention is shown. The audio jack 100 includes an insulating housing 10 and a plurality of contacts received in the insulating housing 10. These contacts are all formed by bending metal plates and include an improved contact 20 and several conductive contacts 30.

Figure 2:
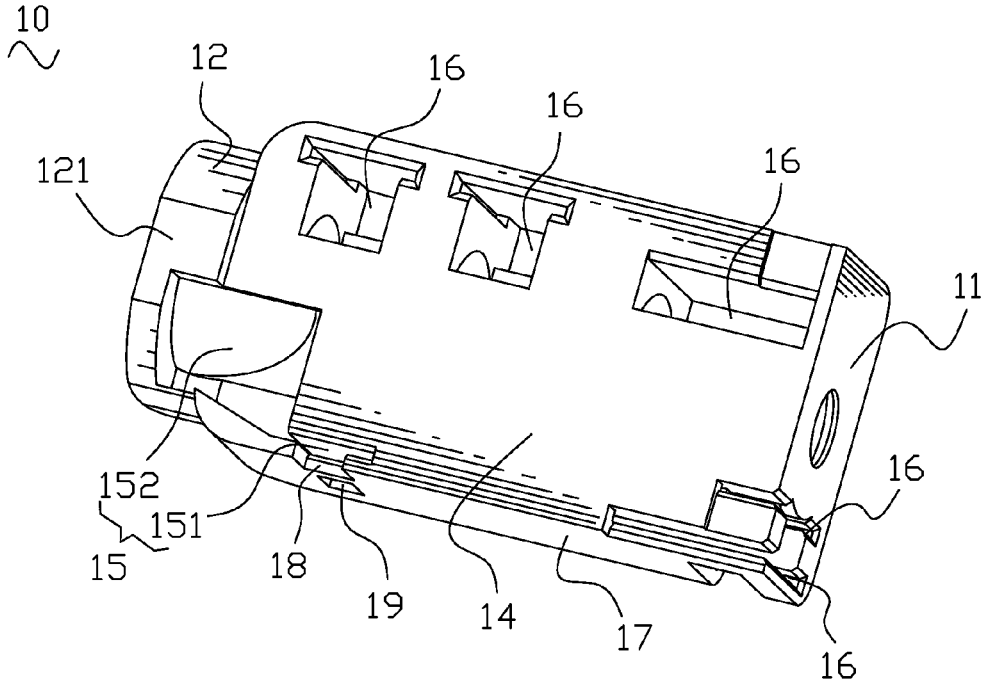
FIG. 2 is a perspective view of an insulating housing of the audio jack shown in the FIG. 1.
Figure 4:
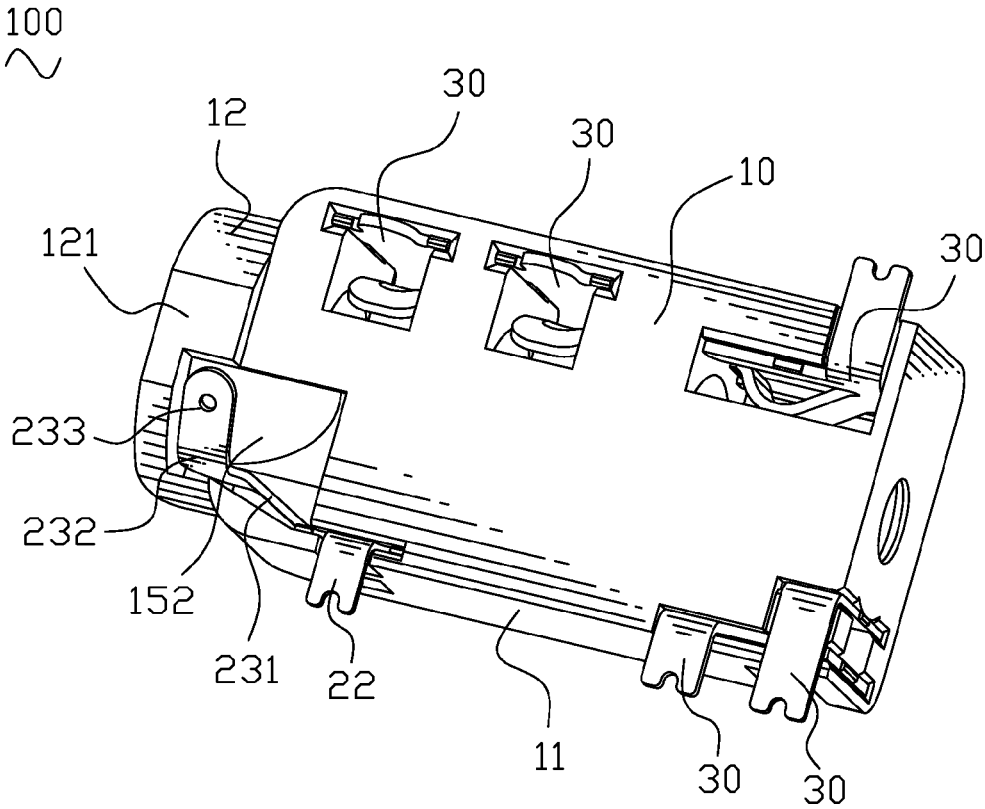
FIG. 4 is another perspective view of the audio jack shown in the FIG. 1.

Please refer to FIG. 2 in conjunction with FIGS. 1 and 4, the insulating housing 10 has a substantially rectangular main body 11 and a sleeve 12 integrally formed at a front of the main body 11. The sleeve 12 is of a cylinder shape, partially cutting away at a top thereof. The main body 11 has an insertion hole 13 extending frontward and rearwards and communicating with the sleeve 12. A bottom surface 14 of the main body 11 defines a recess 15 at a front thereof for receiving the improved contact 20 and a plurality of grooves 16 respectively arranged at two sides thereof for receiving the conductive contacts 30. The recess 15 includes a holding slot 151 adjacent to a side surface 17 of the main body 11 and a receiving cavity 152 in front of the holding slot 151. The receiving cavity 152 communicates with the holding slot 151 and extends through the bottom surface 14 of the main body 11 and a bottom portion 121 of the sleeve 12 to communicate with the insertion hole 13. The side surface 17 has a gap 18 communicated with the holding slot 151 at a lower portion thereof and a locking hole 19 above the gap 18.

Figure 3:
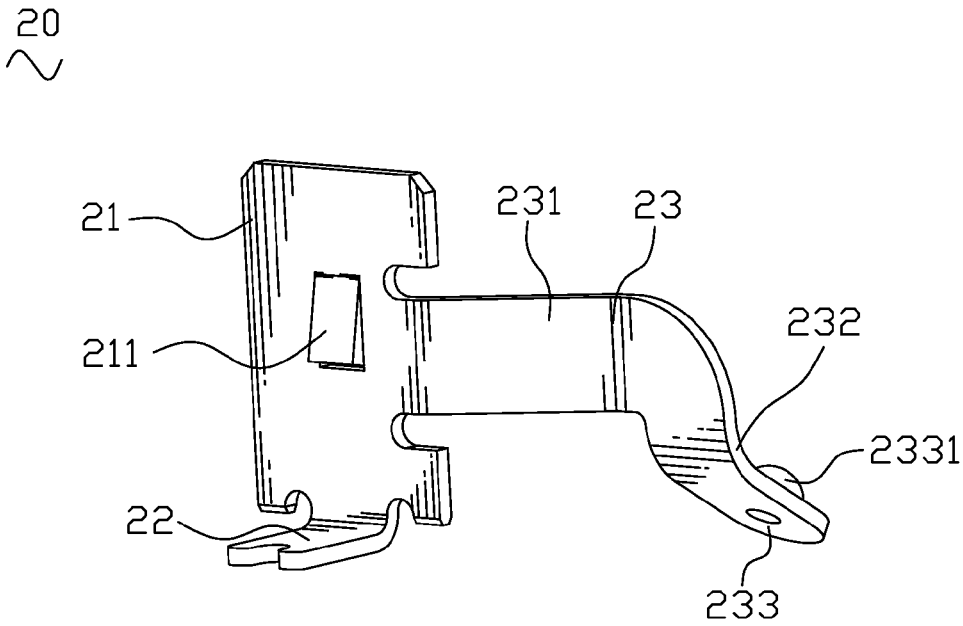
FIG. 3 is a perspective view of an improved contact of the audio jack shown in the FIG. 1.
Figure 5:
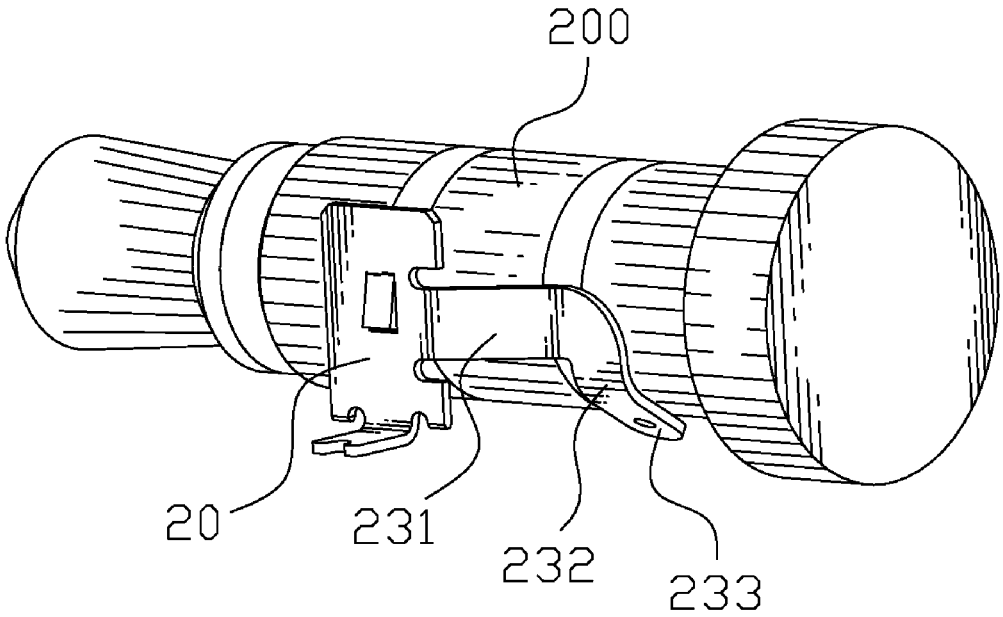
FIG. 5 shows a relationship between the improved contact of FIG. 3 and a mating audio plug in assembly, wherein the insulating housing and a plurality of conductive contacts are removed.

As shown in FIG. 3, the contact 20 has a base portion 21, a soldered portion 22 and a resistance piece 23. The base portion 21 is formed with a barb 211 at a substantial middle portion thereof. The soldered portion 22 bends and extends outward from a bottom edge of the base portion 21. The resistance piece 23 includes an elastic arm 231, an arc-shaped portion 232 and a contact portion 233. In this embodiment, the elastic arm 231 slants in an opposite direction to the soldered portion 22 and extends forward from a front edge of the base portion 21. The arc-shaped portion 232 extends downwards from a distal end of the elastic arm 231 and is arched according to an outer periphery of a mating audio plug 200 (shown in FIG. 5). A distal end of the arc-shaped portion 232 is defined as the contact portion 233. A contact protuberant 2331 protrudes inward from a substantial middle portion of the contact portion 233.

With reference to FIG. 4 in conjunction with FIG. 2, in assembly, the contact 20 is inserted into the recess 15 of the insulating housing 10 from a bottom of the insulating housing 10. The base portion 21 is secured in the holding slot 151 by wedging the barb 211 into the locking hole 19. The soldered portion 22 extends out of the main body 11 from the gap 18. The resistance piece 23 suspends in the receiving cavity 152 and is exposed to the air, with the contact protuberant 2331 projecting into the insertion hole 13 to contact with the mating audio plug 200 (shown in FIG. 5).

As described above, because the arc-shaped portion 232 is arched according to an outer periphery of a mating audio plug 200, the force arm of the contact 20 is lengthened without increasing the length of the resistance piece 23 in an insertion direction of the mating audio plug 200. Therefore, the contact 20 is provided with good elastic deformation and is effectively prevented from plastic permanent deformation even after repeated plugging, and a stable electrical contact between the contact and the mating plug pin is ensured.

What is claimed is:

1. An audio jack for receiving a mating audio plug, comprising:

an insulating housing having an insertion hole for receiving the mating audio plug, a recess formed at a front of a bottom surface of the insulating housing and communicating with the insertion hole; and a contact received in the recess, the contact having a base portion, a soldered portion and a resistance piece, the soldered portion bending and extending outwardly from a bottom edge of the base portion, the resistance piece including an elastic arm, an arc-shaped portion and a contact portion, the elastic arm extending forwardly from a front edge of the base portion, the arc-shaped portion extending downwardly from a distal end of the elastic arm and arched accordingly to an outer periphery of the mating audio plug, a distal end of the arc-shaped portion defined as the contact portion.

2. The audio jack as claimed in claim 1, wherein the insulating housing has a main body and a sleeve integrally formed at a front of the main body, the insertion hole extends frontwardly and rearwardly in the main body and communicates with the sleeve, the recess is defined at a front of a bottom surface of the main body, and includes a holding slot adjacent to a side surface of the main body and a receiving cavity in front of the holding slot, the receiving cavity communicates with the holding slot and extends through the bottom surface of the main body and a bottom portion of the sleeve to communicate with the insertion hole.

3. The audio jack as claimed in claim 2, wherein the base portion of the contact is secured in the holding slot, the resistance piece of the contact suspends in the receiving cavity.

4. The audio jack as claimed in claim 2, wherein, a contact protuberant protrudes inwardly from a substantial middle portion of the contact portion and projects into the insertion hole to contact with the mating audio plug.

5. The audio jack as claimed in claim 2, wherein the side surface of the main body has a gap communicating with the holding slot at a lower portion thereof, the soldered portion extends out of the main body from the gap.

6. The audio jack as claimed in claim 5, wherein a locking hole is defined in the side surface of the main body and above the gap, a barb is defined at a substantial middle portion of the base portion of the contact and wedged into the locking hole to secure the contact.

* * * * *